US006968979B2

(12) United States Patent
Gribble et al.

(10) Patent No.: US 6,968,979 B2
(45) Date of Patent: Nov. 29, 2005

(54) PORTABLE DISPENSER DRIP COLLECTION APPARATUS AND METHOD

(76) Inventors: Gerald Dennis Gribble, 740 E. Center St., Provo, UT (US) 84606; Richard Allen Wall, 1386 W. 2250 S., W.V.C., UT (US) 84119; Gary Arnold Barnes, 1712 N. 1950 West, Provo, UT (US) 84604

( * ) Notice: Subject to any disclaimer, the term of this patent is extended or adjusted under 35 U.S.C. 154(b) by 0 days.

(21) Appl. No.: 10/837,048

(22) Filed: Apr. 30, 2004

(65) Prior Publication Data

US 2005/0242116 A1 Nov. 3, 2005

(51) Int. Cl.[7] ..... B67D 1/16
(52) U.S. Cl. ..... 222/108; 141/86
(58) Field of Search ..... 222/108; 141/86

(56) References Cited

U.S. PATENT DOCUMENTS 163,481 A * 5/1875 Gray ..... 222/108
215,016 A 5/1879 Mettee
555,820 A * 3/1896 Kaup ..... 248/212
1,061,099 A 5/1913 Miller
1,703,284 A * 2/1929 Wolfe ..... 222/108
D326,795 S 6/1992 Reitz et al.
5,470,011 A 11/1995 Jordan
D399,092 S * 10/1998 Miller ..... D7/397
D401,111 S * 11/1998 Leatherman ..... D7/397
5,960,995 A 10/1999 Leatherman et al.

* cited by examiner

*Primary Examiner*—Philippe Derakshani

(57) ABSTRACT

An apparatus and method is disclosed for conveniently reducing spillage from dispensers. A base secures to, or is secured by the base. A holder secures to the base and receives a disposable cup. The disposable cup is typically readily available and may be readily replaced when the cup becomes full. The holder may be adjustable with respect to the dispenser to vary the position of the holder with respect to a spigot. The holder may be secured to the dispenser in an out-of-the-way position for ready storage and transportation. An adjustable holder, or a selectively inserted insert, may enable the holder to accommodate disposable cups of differing sizes.

13 Claims, 7 Drawing Sheets

PORTABLE DISPENSER DRIP COLLECTION APPARATUS AND METHOD

THE FIELD OF THE INVENTION

This invention relates to apparatus and methods for preventing unwanted spillage of fluids from dispensers, and more particularly to portable beverage dispensers having a hand operated spigot.

BACKGROUND

At sporting events and other indoor and outdoor activities it is common to have a beverage dispenser. The dispenser is typically insulated and has a hand operated spigot for dispensing beverages into cups and like receptacles. Typically, the spigot is prone to leak. Even spigots that do not leak are prone to dripping as liquid within the spigot drains therefrom. In either case, liquid tends to spill onto the ground or floor. Such spillage may create a slippery surface. Spillage of sweetened beverages will inevitably lead to a sticky mess, with each person using the dispenser tracking the liquid across the ground or floor.

Prior systems for preventing such problems involve apparatus that integrate a dedicated catch basin and a holder of some type securing the catch basin to the dispenser. However, such systems may be bulky and present some problems in operation. For example, if the catch basin fills and must be emptied, the spills must either go uncatched during emptying or a second catch basin must be provided. Both alternatives increase inconvenience to a user. Requiring a second catch basin adds further difficulty and expense by requiring a user to bring the second catch basin when the device is used and requiring a user to purchase two catch basins.

It would be an advancement in the art to provide a device for catching spillage that could use commonly available receptacles. Such a device would decrease the expense of such a device and allow for ease of operation. It would be a further advance in the art to provide a catch basin comprising the same type of disposable receptacle used by the people dispensing liquid from the dispenser, such as a plastic or paper cup.

BRIEF SUMMARY OF THE INVENTION

An invention is described herein providing an apparatus and method for conveniently and inexpensively collecting spillage from a beverage dispenser. A base is secured to the beverage dispenser, or secured by the beverage dispenser to a supporting surface. A holder secures to the base and is sized to receive a plastic or paper cup. The holder may be embodied as a ring. The ring may be monolithically, or integrally, formed with the base. The ring may be adjustable whether by alteration of shape or by insertion of an adapter to receive differently sized receptacles.

The base may have various configurations. The base may secure to the side or to the bottom surface of the beverage dispenser. The base may be adjustable with respect to the dispenser, or the holder may be adjustable with respect to the base, to position the holder in a desired position with respect to the spigot.

BRIEF DESCRIPTION OF THE DRAWINGS

The operation and functionality of the invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, may be arranged and designed in a wide variety of different configurations. Thus, the following more detailed description of the embodiments of the system and method of the present invention, as represented in FIGS. 1 through 7, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Those of ordinary skill in the art will, of course, appreciate that various modifications to the details illustrated FIGS. 1 through 7 may easily be made without departing from the essential characteristics of the invention. Thus, the following description is intended only as an example, and simply illustrates one presently preferred embodiment consistent with the invention as claimed herein.

Figure 1:
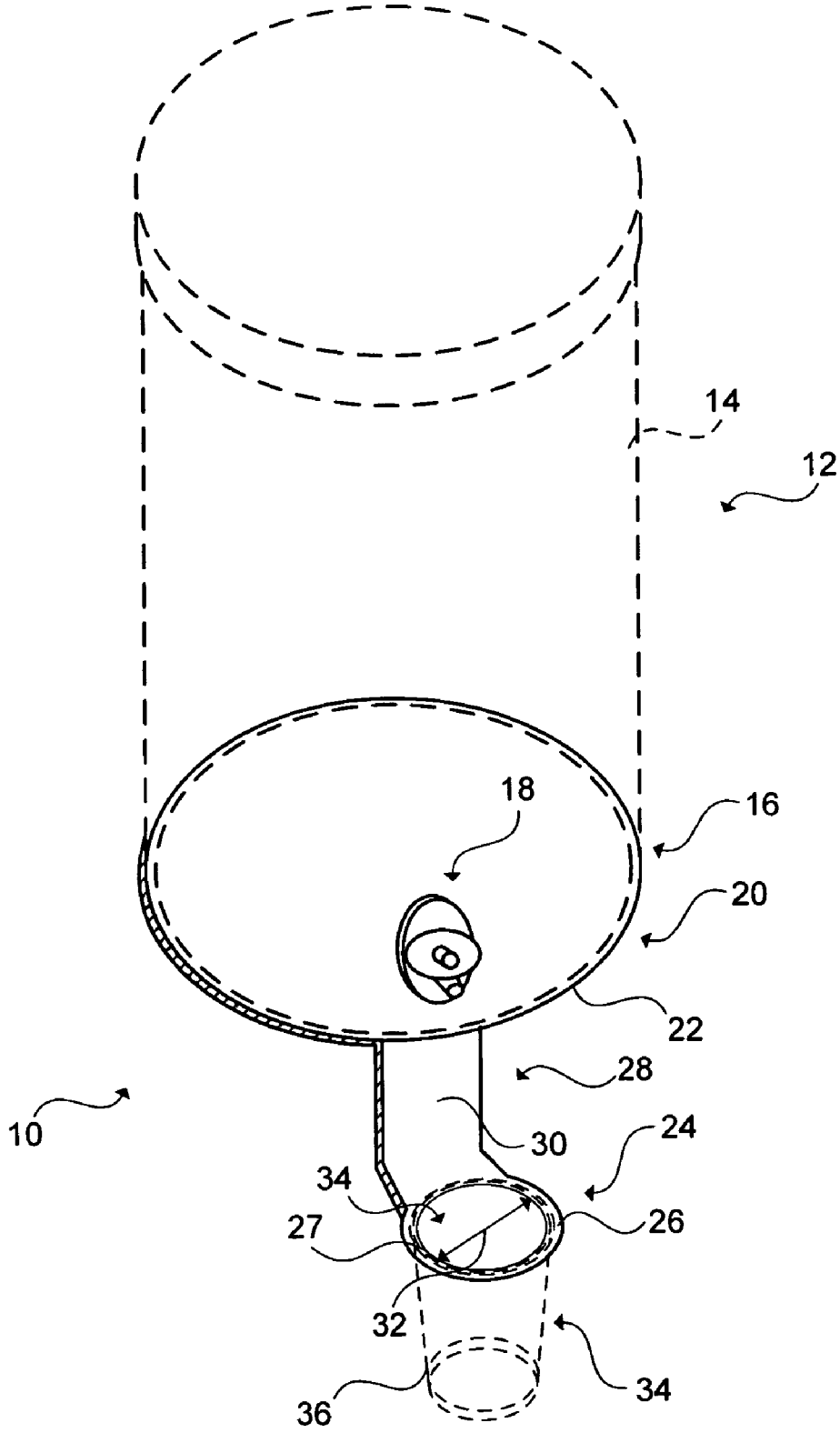
FIG. 1 is a perspective view of a dispenser and holder, in accordance with the invention.
Figure 2:
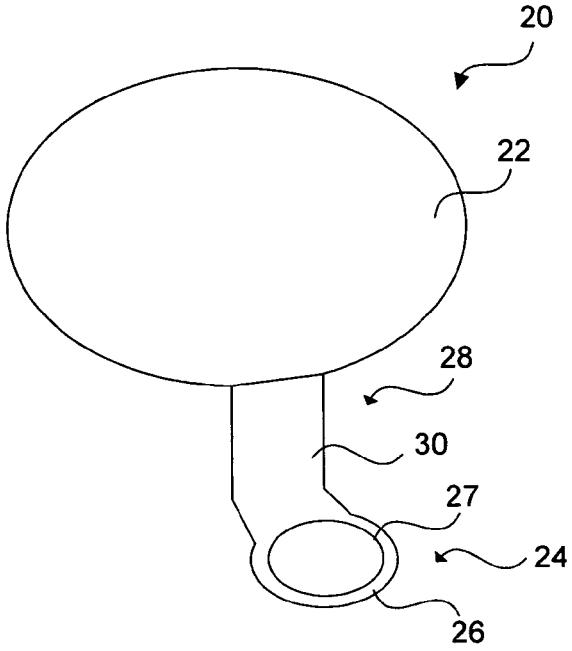
FIG. 2 is a perspective view of a holder and base in accordance with the invention.

Referring to FIGS. 1 and 2, an apparatus 10 may include a dispenser 12. The dispenser 12 may be used for containing and dispensing liquids, may be insulated or uninsulated, and have any size or shape known in the art. In the illustrated embodiment, the dispenser is a cooler 12 having a cylindrical cross section and planar lower surface 16. The dispenser may include a spigot 18, or like structure, for selectively releasing fluid from the dispenser 12.

A base 20 may secure to the dispenser 12. Alternatively the weight of the dispenser 12 may secure the base to a supporting structure such as a table, or like structure upon which the dispenser 12 sits. In the embodiment of FIG. 1, the base 20 is a plate 22. The plate 22 may have a perimeter approximating the perimeter of the lower surface 16. Alternatively the plate 22 may simply include sufficient surface area to engage the bottom surface 16 to prevent unintended removal of the plate due to the weight of any loads placed thereon or accidental bumping. For example, the plate could be formed as a rectangular strip extending substantially to the center, or past the center, of the bottom surface 16.

A holder 24 may secure to the base. The holder may secure a receptacle for collecting spillage from the spigot 18. The holder 24 may be embodied as a ring 26 having an aperture 27. Alternatively, the holder may be two arms, a substantial portion of a ring, a square hole, or the like.

In some embodiments, the apparatus 10 may include a web to maintain the holder 24 distanced from the base 20. In the illustrated embodiment, the web is a strip 30 of material extending between the holder 24 and the base 20. In some embodiments, the holder 24, web 28, and base 20 may be formed monolithically out of the same work piece or material. For example, a plate 22, ring 26, and strip 30 may be formed out of a single sheet of plastic, metal, or other suitable material. A ring 26 may be formed by simply cutting a hold in the sheet of material.

The inner diameter of the ring 32 may be sized to receive a receptacle 34. The receptacle 34 may be a commonly available structure that is readily available, and in some embodiments, disposable. For example, the receptacle 34 may be a disposable cup 36. In most uses of a dispenser 12, disposable cups 36 will be used. Accordingly, a disposable cup will be a good receptacle due to its disposability and ready availability. A particular advantage of the providing a holder 24 receiving a disposable cup is that no additional preparation or equipment is required to replace the receptacle 34 or to provide an initial receptacle 34. In typical use, disposable cups will be available to server beverages independent of the need to catch drips.

Figure 3:
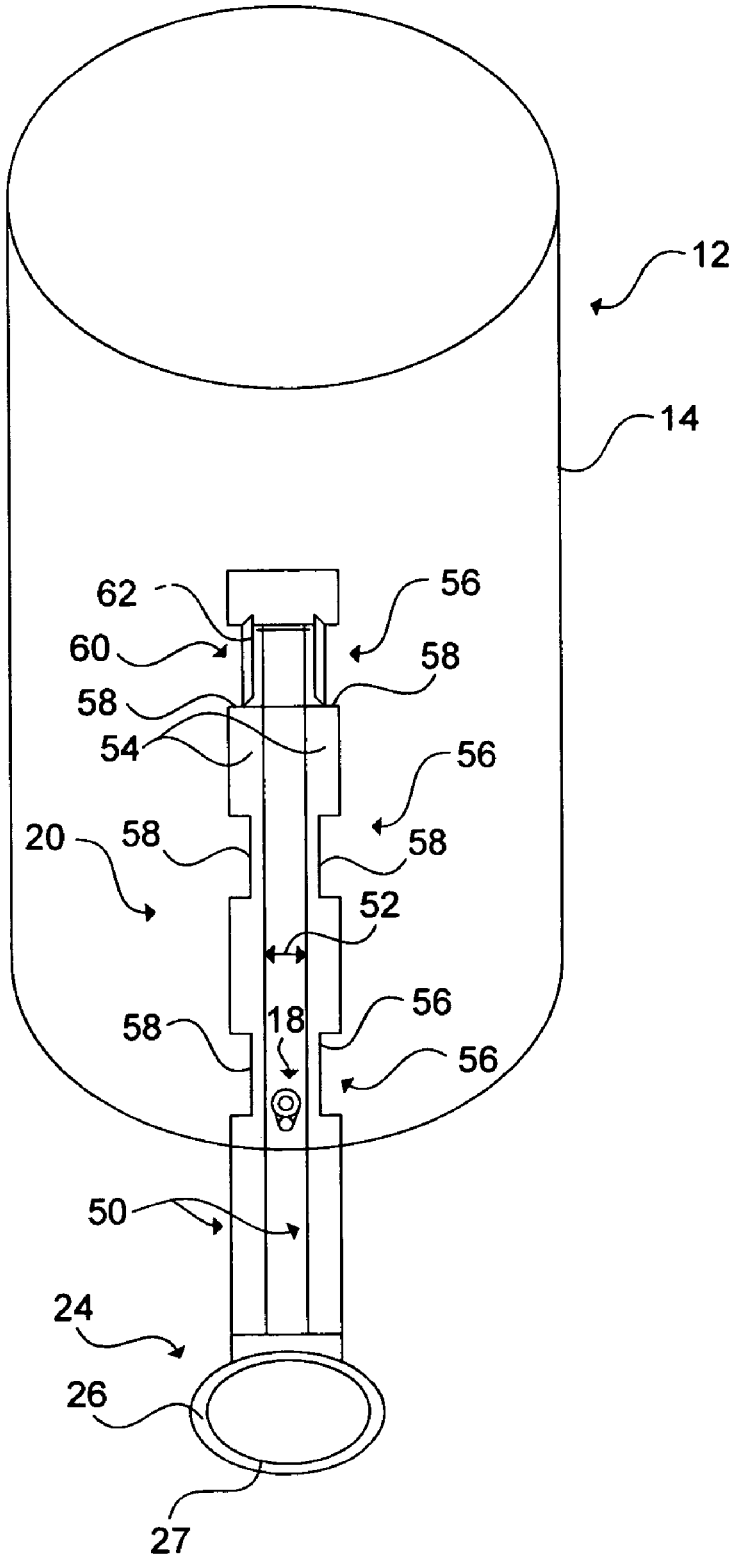
FIG. 3 is a front view of an alternative embodiment of a base, in accordance with the invention.

Referring to FIG. 3, in some embodiments a base 20 may be embodied as arms 50 extending along a surface of the dispenser 12. For example, the arms 50 may extend upwardly along the dispenser 12. The arms 50 may be separated by a distance 52. Separation may enable the arms 50 to lay flat along the surface of the dispenser 12 without interfering with the spigot 18. In the illustrated embodiment, the arms 50 are strips 54 of material, such as metal or plastic secured to the holder 24, such as a ring 26. The strips 54 of material may be formed integrally or monolithically with the ring 26.

A base 20 may include a plurality of engagement portions 56 for engagement with the dispenser 12. A plurality of engagement portions 56 may enable the position of the holder 24 relative to the spigot 18 to be varied. In the illustrated embodiment, the engagement portions 56 may be embodied as grooves 58 formed in the strips 54. Alternatively, the engagement portions 56 may be tabs, or like structure extending from the strips 54.

The engagement portions 56 may engage a securement portion 60 secured to, or forming part of the dispenser 12. For example, a clip 62 may engage the grooves 58 to secure the base 20 to the dispenser 12. In some embodiments, the securement portion 60 may be embodied as one side of a VELCRO, or like fastener, secured to the dispenser 12. Accordingly, the engagement portions 56 may be embodied as strips of VELCRO, extending the entire length of the strips 54 or secured at discreet points on the strips 54.

Figure 4:
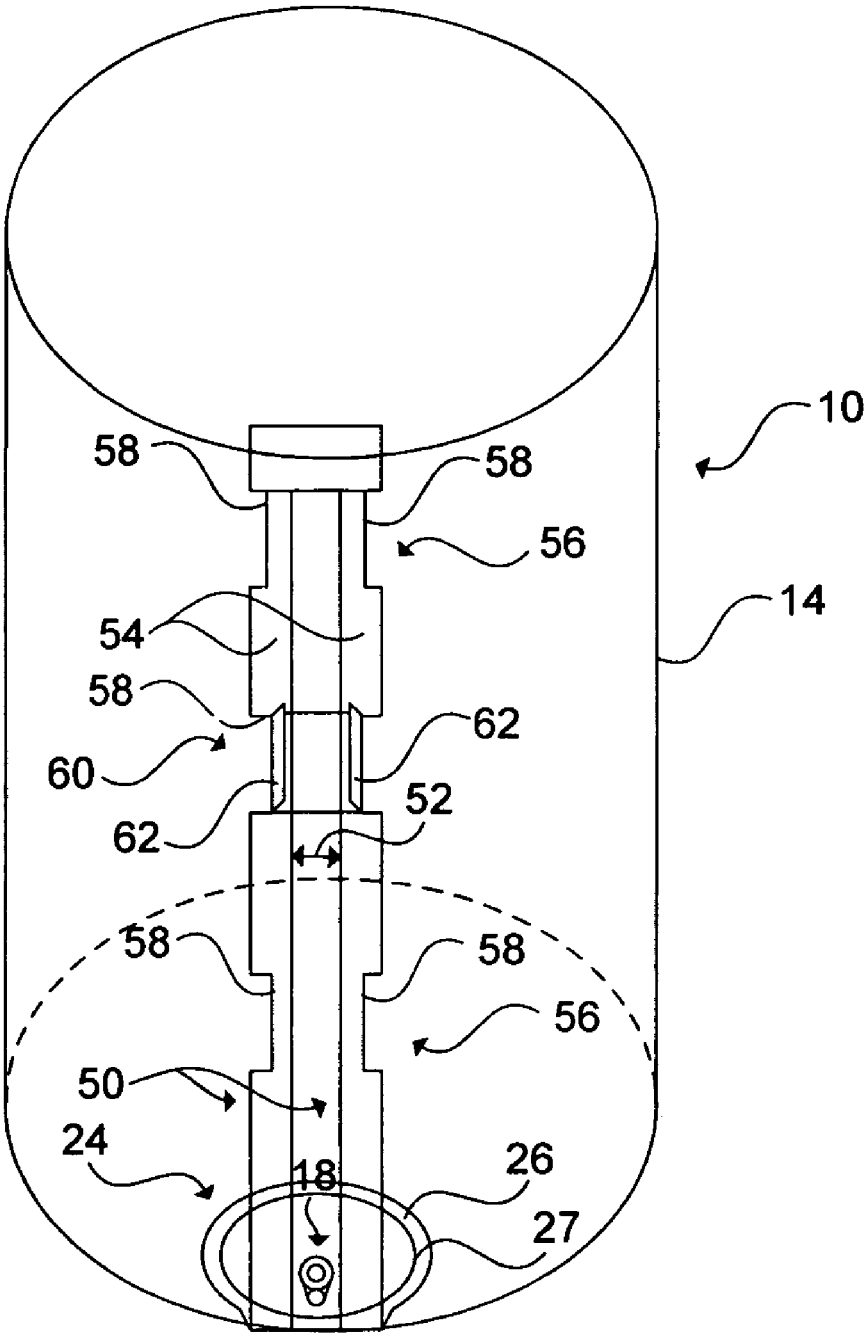
FIG. 4 is a front view of the base of FIG. 3 in a stowed position, in accordance with the invention.
Figure 5:
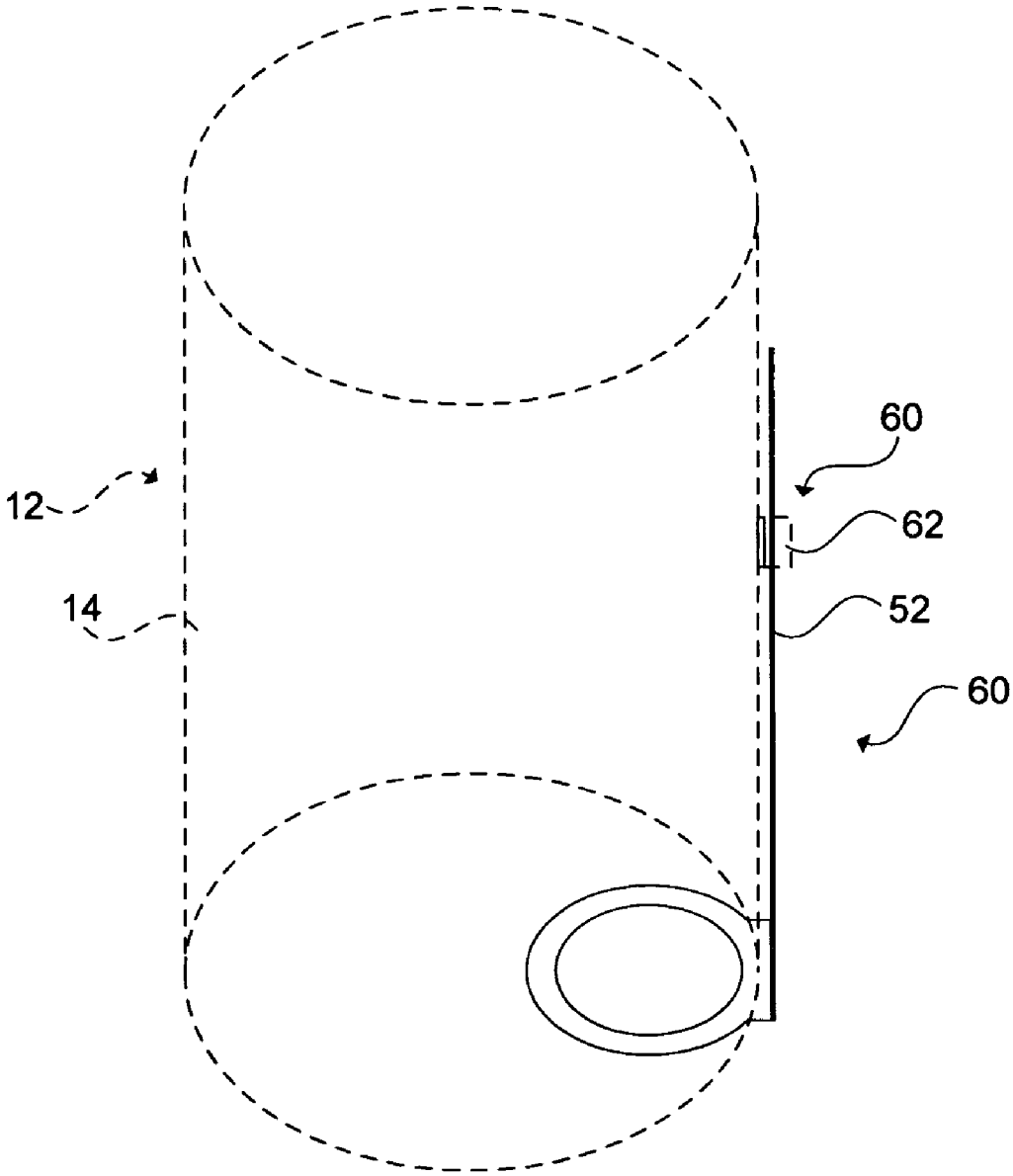
FIG. 5 is a side view of the base of FIG. 3 in a stowed position, in accordance with the invention.

Referring to FIGS. 4 and 5, in some embodiments, the apparatus 10 may be placed in a stowed position with the holder 24 positioned out of the way. For example, the holder may be positioned below the lower surface 16, or facing the lower surface 16 of the dispenser as illustrated. The engagement portions 56 may engage the securement portion 60 in a like manner as in FIG. 3. In some embodiments, sections of Velcro may be provided on either side of the strips 54 so that the strips may be secured to the dispenser 12 in both stowed and deployed positions.

Figure 6:
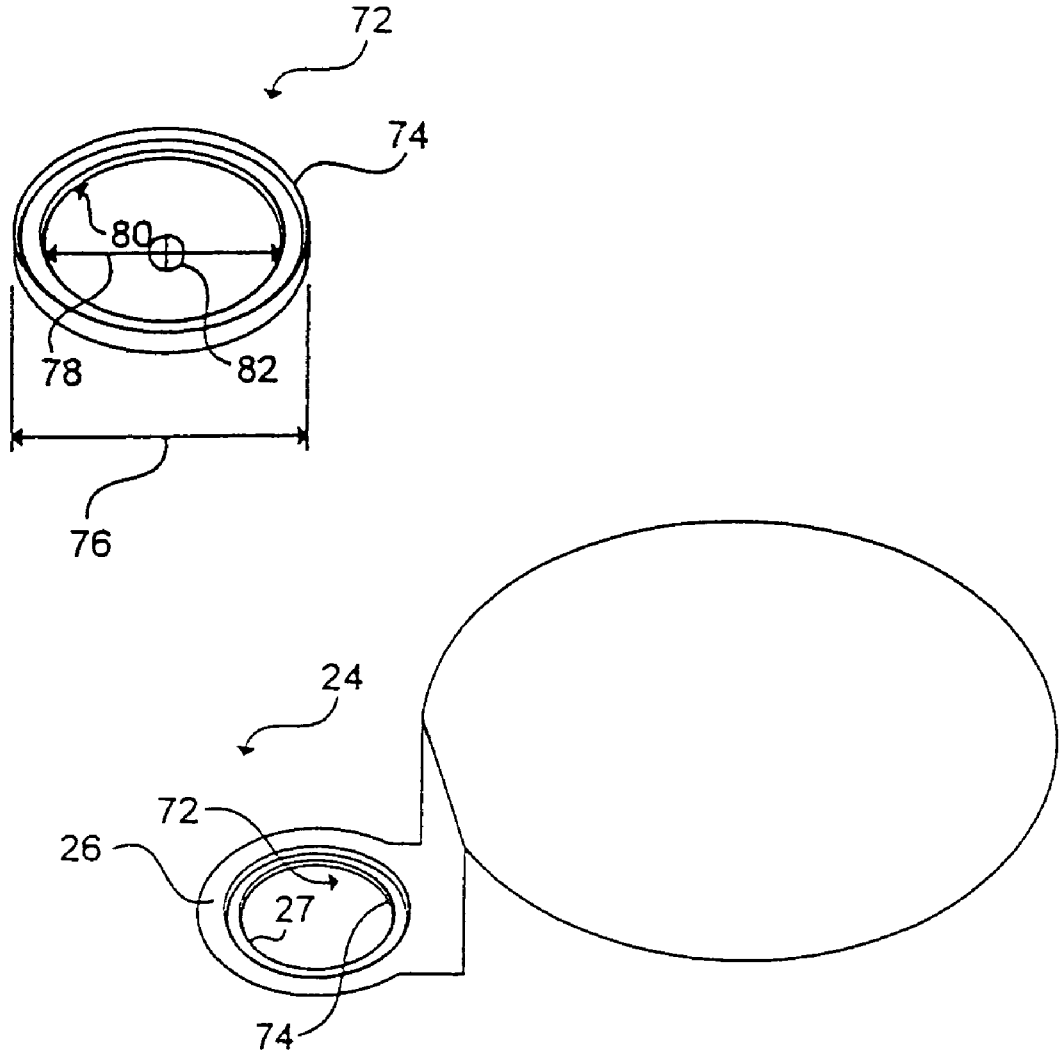
FIG. 6 is a perspective view of a base and holder having an insert in accordance with the invention.

Referring to FIG. 6, in some embodiments the holder 24 may be modified to accommodate receptacles 34 of varying sizes. For example, disposable cups come in various different sizes. In order to be of greatest utility, a holder 24 should accommodate multiple sizes of cups 36. Accordingly, the holder 24 may be modifiable by for example, bending or twisting the holder to change its shape. For example, the holder 24 may be made of resilient but bendable wire that retains its deformed shape if bent, or of resilient but bendable plastic capable of selective deformation. Alternatively, the holder 24 may be configured to be constrictable, for example a strip of plastic that may be drawn across a catch, preventing its release unless manually disengaged (e.g. a releasable zip-tie). Thus, the inner diameter 32 of the ring 26 may be reduced or expanded.

In the illustrated embodiment, an insert 782 is embodied as an insert ring 74 having an outer diameter 76 larger than the inner diameter 32 of the ring 36 forming the holder 24. The inner diameter 78 of the ring 74 may be sized to accommodate a cup 36 of arbitrary size. In some embodiments, a lip 80, rim 80, or like structure 80 may engage the inner surface of the ring 36 to maintain the ring 74 registered with respect to the ring 36.

In some embodiments the center 82 of the hole defined by the ring 74 may be eccentric with the perimeter of the insert 72. That is to say, a smaller cup 36 may not necessarily be positioned to catch drips, whereas a larger cup having a larger cross section is more readily positioned to catch drips. Accordingly, an insert 72 accommodating smaller cups may likewise position the center of the hole defined by the ring 74 such that it is positioned to catch drips.

Figure 7:
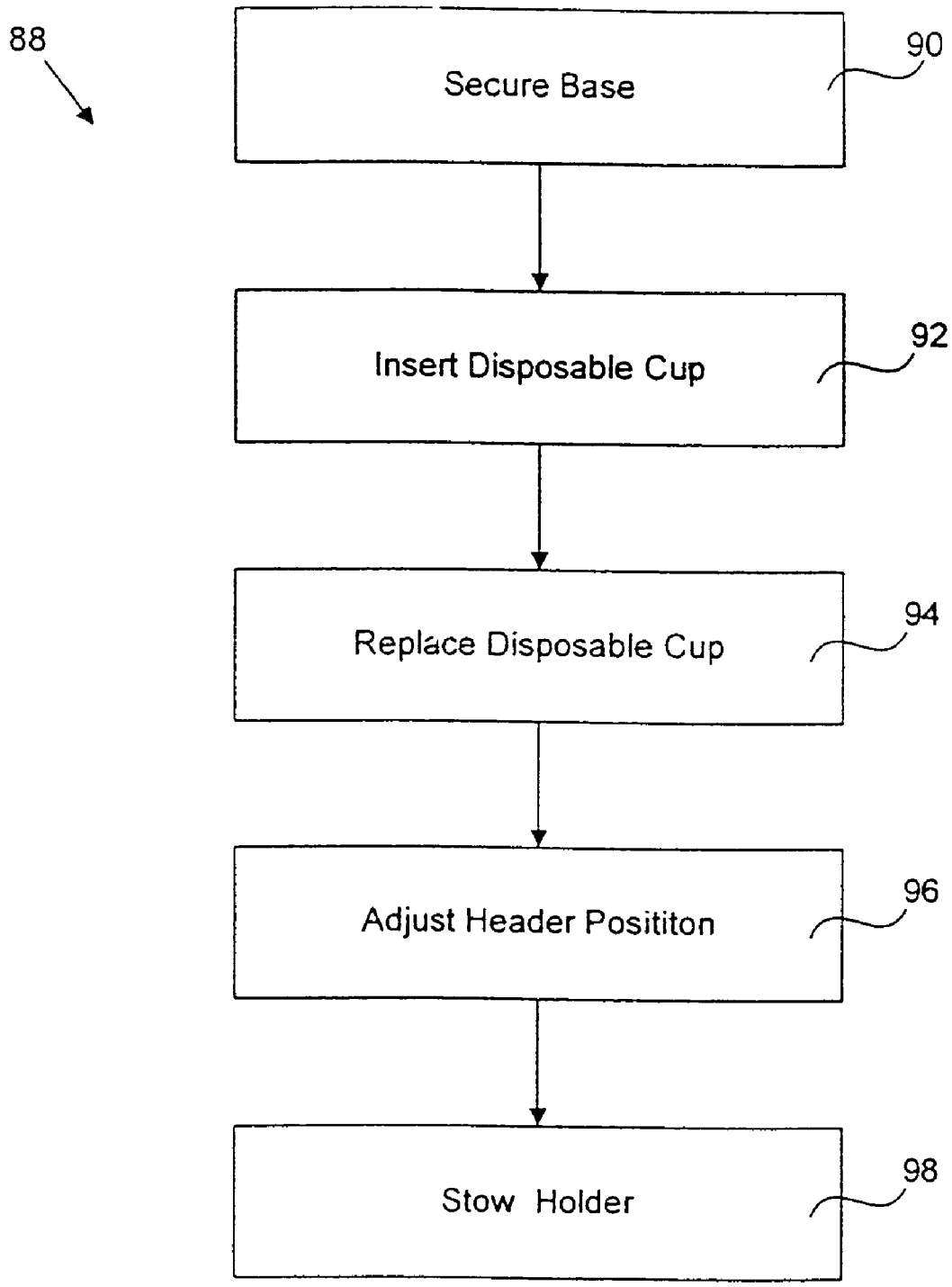
FIG. 7 is a process flow diagram of a method for collecting spills in accordance with the invention.

Referring to FIG. 7, a process 88 may be employed to make use of the apparatus 10. The process 88 may include securing 90 the base to the dispenser. Securing 90 may be accomplished by resting the dispenser 12 on the base 20, or by securing the arms 50 to the dispenser 12. The process 88 may include inserting 92 a disposable cup 36 into the holder 24. The process 88 may include replacing the disposable cup 36 with a second disposable cup 36. The process 88 may include adjusting 96 the holder position. Adjusting 96 may include securing the moving the point of securement of the securement portion 60 from one engagement portion 56 to another engagement portion 56. The process 88 may include stowing 98 the holder. Stowing the holder 98 may include positioning the holder 24 in a position unavailable for catching drips and yet still secured to the dispenser 12. For example, the holder 98 may be positioned as illustrated in FIG. 4.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus for collecting spillage from the spigot of a portable beverage dispenser, the apparatus comprising:

a support structure;

a dispenser comprising a bottom surface to rest on the support structure and a spigot for releasing a fluid;

a base disposed between the bottom surface and the support structure;

a holder secured to the base and sized to receive a disposable cup the holder defining a first aperture sized to receive the cup;

an insert sized to fit within the first aperture, the insert defining a second aperture smaller than the first aperture; and a cup disposed within the holder and positioned to collect fluid released from the spigot.

2. The apparatus of claim 1, wherein the insert is a ring having a ridge formed on an inner surface thereof.

3. The apparatus of claim 2, wherein the base is formed integrally with the holder.

4. The apparatus of claim 3 wherein the holder, web, and dispenser are formed of a monolithic piece of material.

5. The apparatus of claim 4, further comprising a web extending between the base and the holder.

6. The apparatus of claim 5, wherein the holder is positioned lower than the base, the web extending vertically between the holder and the base.

7. The apparatus of claim 6, wherein the cup is disposable.

8. The apparatus of 7 wherein the cup is made of a treated paper and is round in at least one dimension.

9. The apparatus of claim 7, the monolithic piece of material is a thin sheet of plastic.

10. An apparatus for collecting spillage from the spigot of a dispenser, the apparatus comprising;

a dispenser having a spigot;

a support structure supporting the dispenser;

a base at least one of securement to the dispenser and securement by the dispenser to the support structure;

a holder secured to the base and sized to receive a disposable cup made of at least one of paper and plastic; and a first fastening structure secured to the dispenser and a second fastening structure secured to the base, the first fastening structure selectively secureable to the second fastening structure.

11. The apparatus of claim 10, wherein the second fastening structure comprises a plurality of securement points directly securable to the first fastening structure.

12. The apparatus of claim 10, wherein the first fastening structure comprises a plurality of securement points directly secureable to the second fastening structure.

13. The apparatus of claim 12, wherein the first and second fastening structures are mating portions of a VELCRO fastening apparatus, with the first fastening structure comprising a strip of VELCRO extending vertically along the dispenser.

* * * * *